United States Patent [19]

Honegger

[11] Patent Number: 4,494,359

[45] Date of Patent: Jan. 22, 1985

[54] METHOD AND APPARATUS FOR THE LONG-TERM PRESSING OF PRINTED PRODUCTS ESPECIALLY NEWSPAPERS

[75] Inventor: Werner Honegger, Tann-Rüti, Switzerland

[73] Assignee: Ferag Ag, Hinwil, Switzerland

[21] Appl. No.: 338,568

[22] Filed: Jan. 11, 1982

[30] Foreign Application Priority Data

Feb. 3, 1981 [CH] Switzerland ..... 692/81

[51] Int. Cl.[3] ..... B65H 17/02

[52] U.S. Cl. ..... 53/430; 53/118

[58] Field of Search ..... 53/118, 430; 242/59, 242/67.3 R, 75.4, 67.1 R, 67.2, 67.4

[56] References Cited

U.S. PATENT DOCUMENTS

| | | | |
|---|---|---|---|
| 1,126,006 | 1/1915 | Harwood | 242/59 |
| 1,838,065 | 12/1931 | Last . | |
| 3,509,685 | 5/1970 | Sykes | 53/118 X |
| 3,862,802 | 1/1975 | Till | 242/67.3 |
| 3,963,345 | 6/1976 | Stemmle et al. | 242/67.4 X |
| 4,000,864 | 1/1977 | Kurtz et al. | 242/59 |
| 4,063,693 | 12/1977 | Achelpohl | 242/67.1 R |

FOREIGN PATENT DOCUMENTS

| | | | |
|---|---|---|---|
| 153740 | 10/1953 | Australia | 53/118 |
| 54735 | 6/1982 | European Pat. Off. | 53/118 |
| 1244656 | 7/1967 | Fed. Rep. of Germany | 53/118 |
| 2207556 | 6/1975 | Fed. Rep. of Germany | 53/118 |
| 2804178 | 8/1979 | Fed. Rep. of Germany | 53/118 |

*Primary Examiner*—James F. Coan

*Attorney, Agent, or Firm*—Werner W. Kleeman

[57] ABSTRACT

The inherent tendency of printed products, especially newspapers, to change their shape, for instance, because of residual stresses or a restoring action, is to be annihilated by subjecting the printed products to a pressing or compression action. By winding-up the printed products arranged in an imbricated formation and by rewinding the same in the opposite winding sense the products are initially curved in a first direction and then in another direction and pressed into a flat condition. Already during the time that the products are wound into a product package the products become more uniform, as such possibly would be otherwise attainable due to the action of pressure forces over longer periods of time with the utilization of a great amount of equipment expenditure. The winding and rewinding, but also the unwinding, as these terms are used herein, constitute operations accomplished with the aid of a separation or partition element which is under tension, the end of such separation element being connected with the related winding mandril and being wound into the wound package.

8 Claims, 4 Drawing Figures

METHOD AND APPARATUS FOR THE LONG-TERM PRESSING OF PRINTED PRODUCTS ESPECIALLY NEWSPAPERS

CROSS-REFERENCE TO RELATED APPLICATION

This application is related to my commonly assigned co-pending U.S. application Ser. No. 06/280,998, filed July 6, 1981, entitled "Apparatus For Stacking Printed Products, Such As Newspapers, Periodicals And The Like, Arriving In An Imbricated Product Stream" now U.S. Pat. No. 4,438,618 granted Mar. 27, 1984.

BACKGROUND OF THE INVENTION

The present invention relates to a new and improved method of, and apparatus for, the so-called long-term pressing of printed products, especially newspapers. At times throughout this disclosure reference to such method and apparatus will be simply generally made in terms of measures for accomplishing such long-term pressing of the printed products. Equally, while the description to follow, as a matter of convenience, refers to the processing of newspapers, obviously other types of products can be conveniently handled and therefore the use of this term is not to be construed in a limiting sense in any way whatsoever, merely is to be viewed as an exemplary and desirable field of application for the inventive measures.

During the processing of printed products, especially newspapers, there are repeatedly encountered difficulties because such products constititute irregular or non-uniform structures and, in any case, possess or develop properties which, notwithstanding the product uniformity which might be attainable during the production of the products, results in an irregularity or non-uniformity of the products at a later point in time. This is attributable to a considerable degree to the fact that paper constitutes so-to-speak "living" material, i.e. a material which tends to "work", and thus its corresponding properties tend to be particularly perceivable when the paper is used for forming a multi-sheet folded product. Attempts have been made to counteract this phenomenon by resorting to a pressing action exerted upon the products. To that end, the paper products were passed between press cylinders or press rolls which, if desired, also could possess a profiled jacket or outer surface. However, this technique only afforded a pulse-like pressing action which while in most instances resulted in a momentary improvement in the properties of the product did not however eliminate the actual origin of the problem. This is equally the case even if the products are passed a number of times between press cylinders or press rolls. After each pressing operation the residual stress or residual elasticity of the products caused the prior processed product to tend to restore to its original characteristic, especially at the region of the product spine. Consequently, the strived for uniformity in the products was lost or, in a worse case situation, not even attained at all. To preclude the undesirable effects of the residual stress or residual elasticity of the products it would be necessary to subject the products to a pressing action for such a long period of time that no restoring forces are retained any longer in the paper. Yet, this is not possible in those facilities where the product is fabricated or processed, particularly if it is kept in mind that when processing printed products many tens of thousands of product copies must be produced or processed every hour and then frequently twenty-four hours of the day. A further factor worthy of mention is the reality that when dealing with printed products, especially newspapers, periodicals or the like, the contents thereof are short lived, i.e. the newsworthy or other items of interest contained therein usually only have a limited period of time where they are of interest to the reader, and therefore for that reason alone the products cannot be subjected to a pressing pressure or compresive forces which requires any excessive amount of time. This is also true for the so-called preprinted products, i.e. for those product sections which are printed ahead of time and until they are united with the actual newsworthy portion of the printed product are stored in an intermediate storage area. Additionally, even in the case of the pre-printed products, if it were intended to make use of this available storage time for exposing such pre-printed products to a pressing action over a longer period of time, nontheless there would be required an appreciable expenditure in equipment to achieve this result.

SUMMARY OF THE INVENTION

Therefore, with the foregoing in mind it is a primary object of the present invention to provide a new and improved method and apparatus for the long-term pressing of products, especially newspapers, in a manner not afflicted with the aforementioned drawbacks and limitations heretofore discussed.

Another and more specific object of the present invention is directed to the provision of a new and improved method and apparatus for the long-term pressing of printed products, especially newspapers, which enables reliably transforming the products into a desirable permanent condition which otherwise only would be attainable by carrying out a pressing operation over a longer time span, without however, in reality, having to utilize a correspondingly large amount of time to achieve this result.

A further significant object of the present invention, and in keeping with the immediately preceding object, and stating the same in a somewhat different manner, is to compensate the necessity of otherwise exposing the products to a pressing action over a long time, by using measures which in fact shortens the duration of the pressing operation while achieving the beneficial result that the desired permanent condition of the products nonetheless can be realized.

Perhaps one obvious way in which to effectuate a shortened pressing time would be to press the products individually or in a stacked configuration by exerting extremely high pressing forces. But that technique would require an appreciable expenditure in equipment, and nonetheless the attainable success would be questionable, particularly since time-consuming operations could not be avoided which then basically would minimize any savings in time otherwise obtained.

The teachings of the invention proceed from entirely different deliberations. The method aspects of the invention afford successful results in that the products, while in an imbricated product formation or configuration, are initially for instance tightly wound up while the product spine leads and then tightly rewound up again while moving in the opposite direction or sense, and in each instance the infed products are furnished to the wound package from below. Consequently, initially the product spine is acted upon or grasped, with the result that the layers or plies of the products which are folded on top of one another initially are still free and can yield during the more or less considerable pressing flat of the product spine. At the region of the wound package these layers are curved and in this condition they experience a pressing or compressive force. The products located at the centre of the wound package are those which are most intensively curved and maintained under pressure for the longest amount of time. The further that the products are located radially outwardly in the wound package the more that their curvature decreases, so that they enter the wound package progressively at a later point in time and consequently are exposed for an increasingly shorter duration to the pressing or compressive forces. During the rewinding of the package these conditions are altered in that initially the products located outermost at the wound package now arrive at the center of the rewound package and now are exposed to a pronounced curvature throughout a relatively longer time span. During the rewinding operation the products are engaged at their cut-portions or flower, meaning the part of the product located opposite the product spine, and the layers of the products which are refolded upon one another are fixed. If notwithstanding the preceding pressing action there nonetheless still remains a residual stress or residual elasticity at the region of the product spine, then the product spine which lastly experiences a pressing or compresive force is again pressed flat, and thus, exposed to a complex deformation since the product layers which have been folded on top of one another no longer can yield. By virtue of these measures there is imparted to the products, after the rewinding operation, a permanent flat condition, also in those instances where even following the completion of the rewinding operation the products experience a further working operation, i.e. the products are immediately removed from the second wound package. After the winding and rewinding operations described above have occurred the products now are present in a so-to-speak "ripened" condition which is the same from product-to-product and is permanently maintained. Products which have been processed in this fashion can be considered to constitute precision structures which during the subsequent further processing thereof, which obviously may be carried out through the use of automated machinery, can be engaged and manipulated without any problems. This holds particularly true for the pre-printed products or pre-products, which are not immediately processed following the rewinding operation, rather are initially stored in an intermediate storage area for a certain amount of time as required by the course of the encountered operating conditions. Also in this case it is unnecessary to alter the actual system operation of the plant; quite to the contrary, the intermediate storing of the products which is governed by the operation of the plant can be beneficially utilized for imparting uniformity to the products without there being associated therewith any special expenditure in equipment or operating personnel.

The long-term or permanent pressing which is accomplished within a relatively short amount of time is particularly then successful if during the winding operation and rewinding operation there is wouhd into the package between the package layers or plies a separation layer which is under tension or tensional stress. In this way it is not only possible to generally increase the pressing force, but also it can be locally intensified, particularly if the separation layer is relatively narrow. As a result there is formed, particularly at the product spine, a structural stiffness in the sense of transversely reinforcing the products. Also in this case the products are exposed to a surface compression or pressing action and there are produced neighboring zones possessing increased and lower pressing force.

As alluded to above the invention is not only concerned with the aforementioned method aspects, but also relates to a novel construction of apparatus for the performance thereof. To achieve the aforementioned measures the inventive apparatus for the long-term pressing of printed products, especially newspapers, contains means for winding up printed products, especially newspapers, which are present in an imbricated product formation onto a winding mandril and for the rewinding of the wound package containing such printed products onto another winding mandril. In each case the take-up winding mandril has connected thereto one end of a separation element which is wound-up upon a brakable supply roll or spool, the separation element being infed from below to the related winding mandril. Additionally, there are means for the removal of the separation element wound into the package and means for braking the relevant package pay-off winding mandril. During the winding-up operation the take-up mandril is driven and the separation element is braked, so that there is formed in the separation element the requisite tensional stress and there result the required pressing forces. The foregoing holds true during the rewinding operation as concerns the take-up winding mandril and the paying-off winding mandril is then braked. It is driven by withdrawing the wound-in separation element constituting a tension element. The same is analogously true when the products are removed from the second product package. Here, however, the second package previously can be placed in an intermediate storage or storage area. For this case it is then possible to impart the required coherency to the wound package by wrapping the separation element a number of times about the wound package. This also is of course true when the package is shifted or displaced for the purpose of rewinding or unwinding the package, for instance from a drive unit to a brake unit. In this connection reference is made to the fact that the term winding mandril, as such expression is used in the context of this disclosure, is to be understood in its broadest possible sense. Hence, under the expression "winding mandril" or equivalent terminology as employed in this disclosure there is also encompassed, for instance, a sleeve which, in turn, can be mounted upon a driven or braked shaft journal or the like.

BRIEF DESCRIPTION OF THE DRAWINGS

The invention will be better understood and objects other than those set forth above, will become apparent when consideration is given to the following detailed description thereof. Such description makes reference to the annexed drawings wherein there has been schematically illustrated and purely by way of example and not limitation the procedures of winding, rewinding and unwinding of the packages and the essential parts of the equipment needed for such purposes and specifically wherein.

DETAILED DESCRIPTION OF THE PREFERRED EMBODIMENTS

Figure 1:
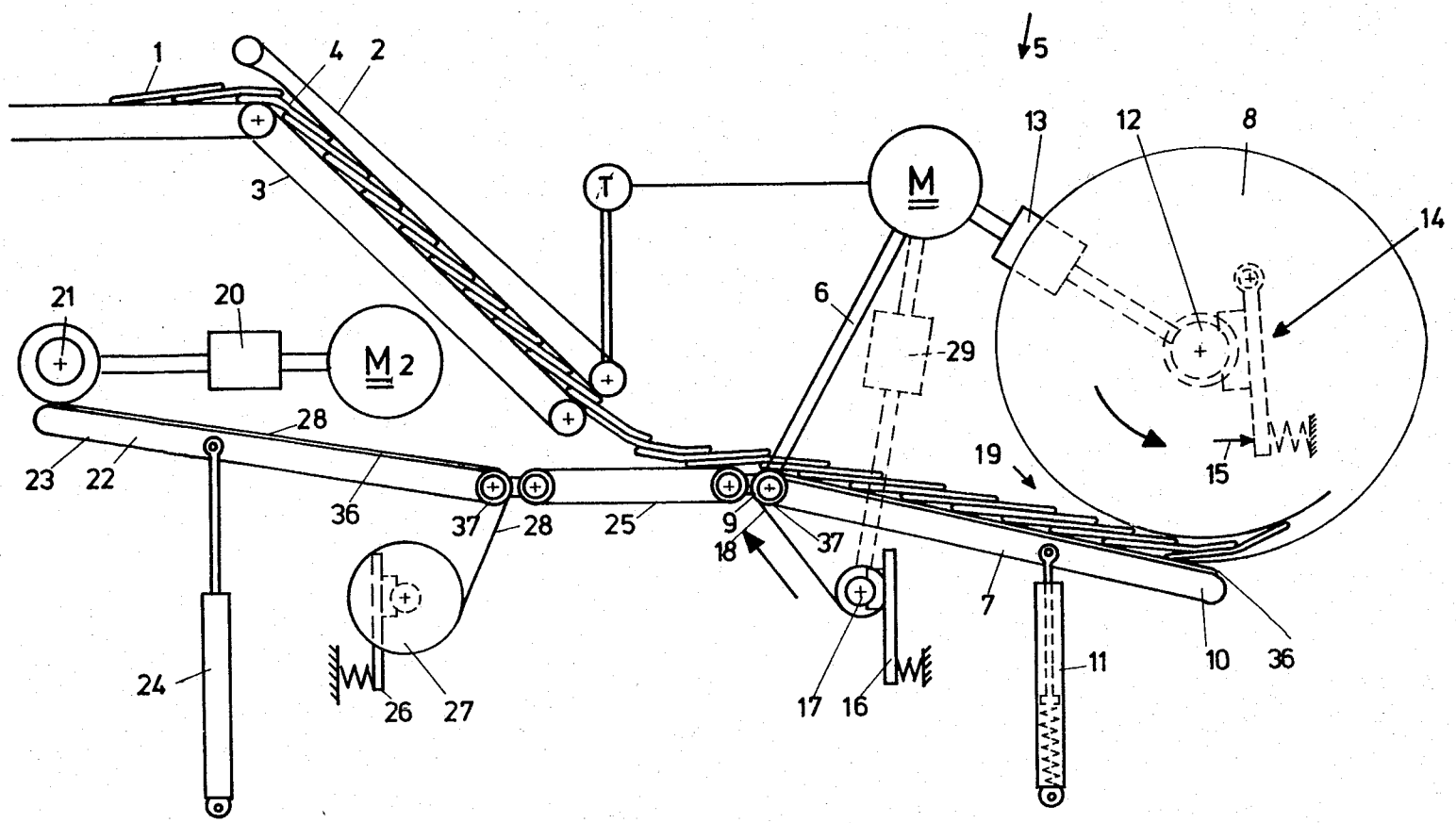
FIG. 1 is a side view of an exemplary embodiment of apparatus for winding a package.

Prior to a further detailed description of the measures of the invention, it is intended to clearly indicate at this portion of the disclosure that the different units or devices of the apparatus, which also could be referred to as stations, need not in any manner be locally or bodily interconnected with one another; quite to the contrary, they could be erected and constructed in accordance with the particular characteristics of the encountered plant or facility. On the other hand, the units or stations also could perform a plurality of functions. Thus, for instance, as shown in FIG. 1, and as shall be explained more fully hereinafter, two winding stations could be arranged next to one another, one of these winding stations could serve as the rewinding station, in other words the rewinding operation could be accomplished without having to shift the first wound package. Conversely, it is however also possible for the wind-up station for the first wound package to also accomplish the rewinding of such package which, in such case, then however would require the shifting or displacement of the first wound package. Stated in another way: it is only necessary that there be provided the means needed for carrying out the individual functions, and it is generally immaterial whether and in which fashion such means are structurally and functionally combined with one another.

Turning attention now to FIG. 1, the arrangement shown therein illustrates that the printed products 1, which may be directly removed from, for instance, a rotary printing press, can be infed through a feed or delivery channel 4 constituted by the conveyor belts 2 and 3 or equivalent structure, to a winding station, here generally indicated in its entirety by reference numeral 5. By means of a tachogenerator T the conveyor belts 2 and 3 and a drive motor M are operatively interconnected with one another for synchronous operation. By means of the drive motor M a further conveyor belt 7 or the like can be driven through the action of a suitable drive connection 6. The conveyor belt 7 infeeds the imbricated product stream from below to the package 8 which is being formed. In the embodiment under discussion the conveyor belt 7 is trained at location 9 about a pivotably mounted balance or rocker 10 which is pressed against the wound package 8 by a suitable pressing or contact mechanism 11, for instance constructed as a spring storage.

The wound package 8 is supported by a winding or wind-up mandril 12 or equivalent structure which is driven by the drive motor M by means of a winding gearing or transmission unit 13. Such winding gearings 13 are well known in this art; they alter the winding velocity of the winding mandril 12 as a function of the increasing package diameter. The winding mandril 12 has operatively correlated therewith a brake device 14 which therefore during the winding operation is vented, as the same has been indicated generally by the arrow 15.

A separation or partition element 18, for instance a band-shaped separation element 18, extends from a supply spool or roll 17 which is braked by brake device 16 to the conveyor belt 7 and bears against the upper run of such conveyor belt 7. This separation element 18 therefore engages below the imbricated product stream and is incorporated together with the imbricated product stream into the winding operation. To achieve this result the end of the separation element 18 is connected with the winding mandril 12 and the withdrawal or removal of the separation element 18 is accomplished by the drive motor M against the action of the brake or brake device 16. This separation or partition element 18 therefore is continuously exposed to tension and forms in conjunction with the winding mandril 12 or, as the case may be, with the thereon wound package, a winding nip or clamping gap 19 which receives the imbricated product stream. As already previously explained, the separation element 18 serves to act upon or engage with the product spine at the winding nip 19 and incorporates the products into the package being wound, these products of the package initially being more intensely curved and then progressively less curved and being exposed to a pressing or compressing action.

As will be recognized from the illustration of FIG. 1, there is provided a second drive motor $M_2$ which drives a second winding or wind-up mandril 21 by means of a winding gearing or transmission unit 20. A rocker or balance 22 equipped with a conveyor belt 23 and a pressing or contact device 24 and operatively associated with such winding mandril 21 is connected by means of a conveyor belt 25 with the conveyor belt 7. Connected with the winding mandril 21 is one end of a separation or partition element, here generally designated by reference character 28. This separation of element 28 bears upon the rocker element 22 and is paid-off of a supply spool or roll 27 which is braked by the brake device or brake means 26. The direction of rotation of the winding mandril 21 is opposite to that of the winding mandril 12. The conveyor belt or band 23 obviously possesses a suitable direction of movement. The same also is true for the conveyor belt 25 or the like. The conveyor belt 7 is reversibly driven, so that during the rewinding operation it can be switched-over so as to possess the same direction of travel as that of the conveyor belts 23 and 25.

Figure 2:
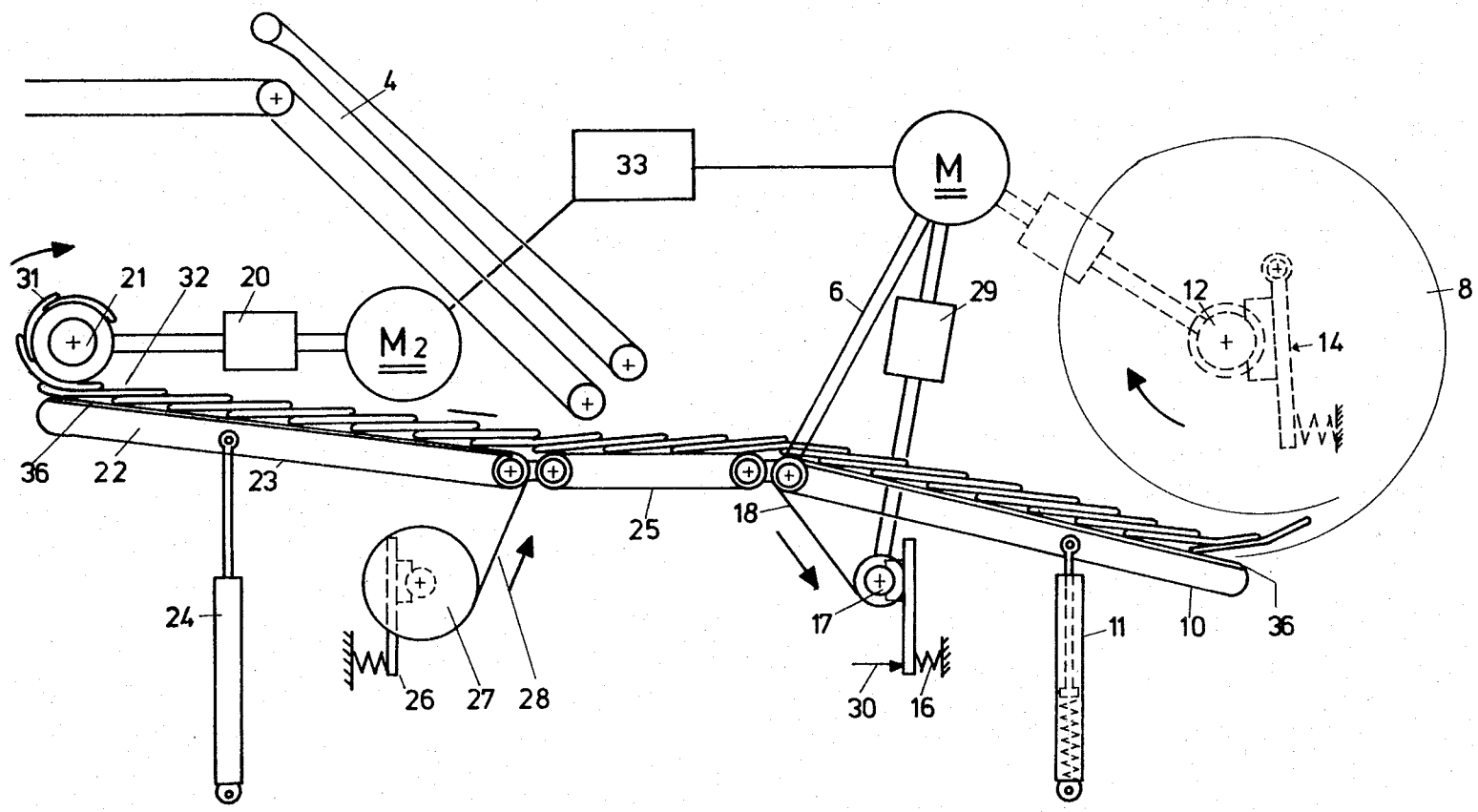
FIG. 2 illustrates the same apparatus as shown in FIG. 1 during the rewinding of the package.

FIG. 2 illustrates the rewinding operation. The drive motor M now drives the supply roll or spool 17 by means of a winder gearing or transmission 29 and the brake unit 16 is suitably vented as generally indicated by the direction of the arrow 30. Now however the brake unit 14 for the winding mandril 12 is placed into operation. The package 8 is placed into rotation by withdrawing the separation element 18. The wound-off imbricated product formation travels over the rocker means 10, the conveyor belt 25 and the rocker means 22 and enters from below the winding mandril 21 and the package 31 wound thereon which has only been schematically illustrated. Also in this case there is provided a winding nip or clamping gap 32 between the separation or partition element 28 and the winding mandril 21 or the thereon wound package 31, as the case may be. In this case, however, the products are engaged at the winding nip 32 at their opposite side, i.e. at the so-called cut or flower side which is directly opposite the product spine. The products are now curved towards their other side, and the products which were less curved during the prior winding-up operation now experience a more intensified curvature and remain for a longer amount of time in the wound package since they, in this case, first enter the wound package 31. The pressing action progresses from the cut side in the direction of the product spine, and the layers of the products which are folded on top of one another are then fixed and the product spine is so-to-speak ironed or pressed flat. This can result in a complex deformation in the event that the product spine has recovered from the prior pressing action during such time as it moves from the package 8 towards the package 31, something which cannot be precluded particularly for the package plies or layers which are disposed radially more outwardly in the wound package 8. The renewed flat pressing of the products with the layers or plies fixed results with certainty in a final flattening of the product spine. Of appreciable significance is also the curvature of the products first in the one direction and then in the other direction, since particularly when handling multi-sheet, folded products it is thus possible to eliminate stresses and irregularities in the products and to annihilate any residual restoring forces which otherwise might be present.

Figure 3:
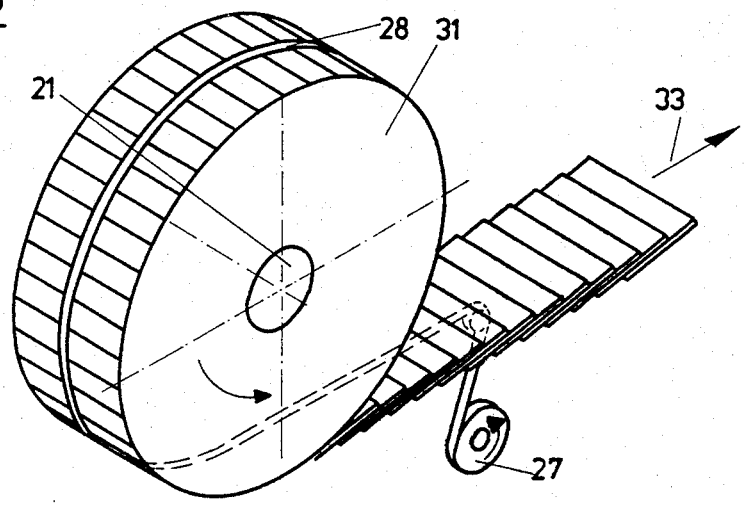
FIG. 3 shows in perspective illustration the second package, there having been indicated the unwinding thereof.
Figure 4:
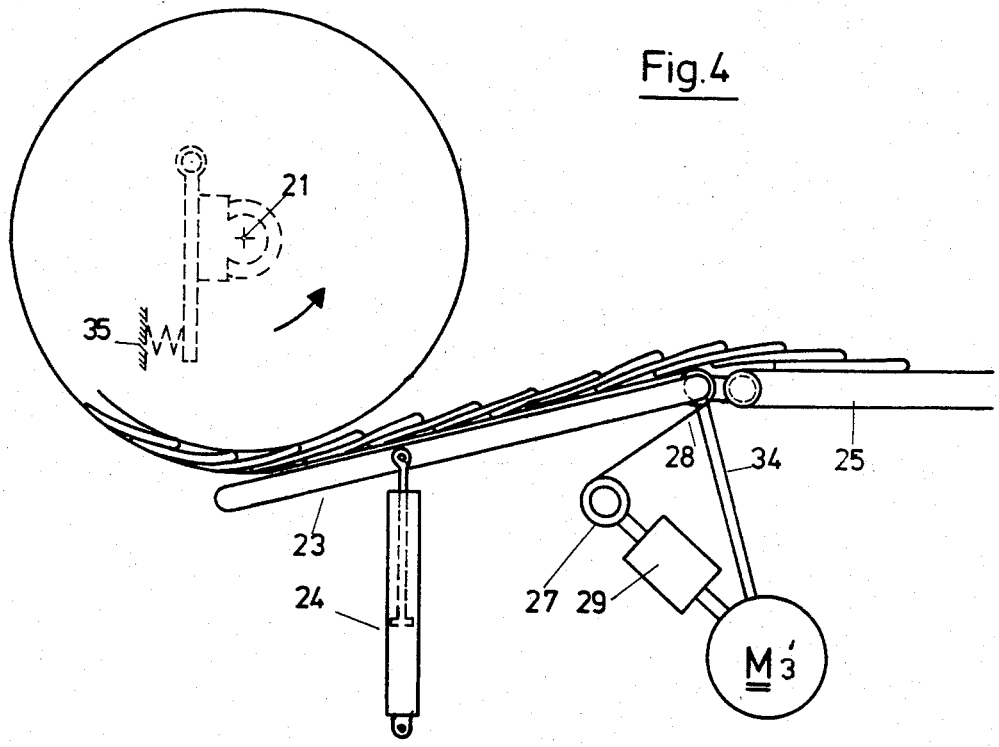
FIG. 4 illustrates the apparatus during the unwinding of the second package.

The complete package 31 has been shown schematically and in perspective view in FIG. 3, there being especially evident that the separation or partition element 28 is structured as a narrow band or tape. As indicated by the arrow 33 the package 31 is represented in a state where it is in the process of being unwound. This is accomplished with the aid of the separation element 28, constituting a tension element, which has been wound onto the spool or roll 27. The spool 27 is now driven by a drive motor $M_3$ (FIG. 4), through the action of any suitable drive connection, and this spool or roll 27 travels in synchronism with the conveyor belt 23. This conveyor belt 23 is switched-over from its direction of travel which it had in the arrangement of FIG. 2 during the winding-up operation into the opposite direction of travel. The winding mandril 21 is braked by a brake device or unit 35. In the arrangements of FIGS. 2 and 4 there have been used generally the same reference characters to denote the same or equivalent elements. Yet, it is to be understood that these figures need not represent the same pieces of equipment during different operating phases, rather such can represent separate pieces of equipment, namely according to the showing of FIG. 2 at the left-hand portion thereof such can comprise an arrangement for performing the rewinding operation whereas the equipment of FIG. 4 constitutes an arrangement or apparatus for the unwinding operation. The last-mentioned apparatus then corresponds to the apparatus shown in the right-hand portion of FIG. 2 at its there illustrated operating phase, and logically in FIG. 1, the right-hand portion thereof, the same piece of apparatus would be illustrated in a different operating phase. With this comparison and with the foregoing explanation it is again intended to underscore that each station can be designed to accomplish multiple functions. Thus, for instance, the equipment shown at the right-hand portion of FIG. 1 also can be used during the rewinding operation instead of the equipment shown at the left-hand portion of FIG. 2, in which case the package 8 previously must be shifted to the second winding mandril 21 and then such winding mandril need only be equipped with a brake.

In the preceding discussion there have been described the operations which result within a very short amount of time in a long-term pressing of folded printed products. The same measures also can be successfully utilized with individual sheets. Such individual sheets are also freed of stresses or, as the case may, subjected to predetermined stresses by virtue of the alternate curvature of the sheets and their remaining in this or the other curved condition, these stresses then mutually compensating one another and placing the product into a permanent desired condition or state. Thus, for instance, it is possible to prevent single-sheet products from tending to arch or curve, undulate or have their corners curl. Naturally, even in the case of single-sheet products the long-term effect is intensified if these single-sheet products are placed in an intermediate storage in the event that such products are to be thusly stored for some reason. What is decisive in each case is that although the intermediate storage does intensify the long-term pressing action, however an adequate effect can be obtained even without any intermediate storage of the products. On the other hand, for a great many products the need for intermediately storing the same cannot be eliminated. By virtue of the rewinding of the products the otherwise passive storage of the products affords a special function in that the wound-up products and then the rewound products tend to "ripen" during the storage into actual precision structures. The further processing of such products is therefore free of random changes in shape due to any restoring action. This is also of great significance because the pre-products which are stored at an intermediate storage are intended to be stuffed into the remaining product sections, so that there can be facilitated a difficult operation, namely the stuffing operation and such can be rendered relatively foolproof or free of malfunction.

The converyor belts 7 and 23 described above also can be dispensed with, in which case the rocker or balance means 10 and 22 could be equipped with only slide or guide rails 36. In this case there would still be provided at the free end of the rocker means 10 and 22 the deflection rolls 37 for the separation elements 18 and 28, respectively. These deflection rolls 37 can be in operative connection with the drive motors M and $M_3$, respectively, throughout each phase in which the separation element 18 or 28, as the case may be, is retracted from the package. This operative connection could encompass the conveyor belt 25. In certain cases the printed products can be fed to the first wound package also with the cut portion of the product leading.

While there are shown and described present preferred embodiments of the invention, it is to be distinctly understood that the invention is not limited thereto, but may be otherwise variously embodied and practiced within the scope of the following claims. Accordingly,

What I claim is:

1. A method for the long-term pressing of printed products, especially newspapers, each of the products having a product spine, comprising the steps of:

providing an imbricated arrangement of the products so as to define an imbricated product stream;

feeding the printed products in the imbricated product stream so as to move in a first predetermined direction with the product spine leading;

tightly winding the thus infed imbricated product stream while moving in said predetermined direction into a wound package;

unwinding the wound package and rewinding the previously wound package while moving the unwound imbricated product stream in a direction opposite to said predetermined direction so that the product spine trails;

tightly rewinding said imbricated product stream while moving in said other direction into a rewound package; and both the initial winding of the package and the rewinding of the unwound package into a rewound package is accomplished by infeeding the product stream from below into the package being wound.

2. The method as defined in claim 1, further including the steps of:

winding into the wound package both during the initial winding thereof and during the rewinding thereof a separation layer which is under tension and which is incorporated between wound plies of the wound package.

3. A method for the long-term pressing of printed products, especially newspapers, each of the products having a product spine, comprising the steps of:

respectively winding an imbricated product arrangement initially with the product spine thereof leading and then in an opposite direction with the product spine trailing into respective wound packages; and infeeding to the package being formed the imbricated product arrangement from below to such package which is being formed.

4. An apparatus for the long-term pressing of printed products, especially newspapers, comprising:

means for winding printed products present in an imbricated product stream onto a winding mandril to form a wound package;

means for rewinding the wound package onto a different winding mandril;

means for supplying a separation element from below onto a related one of the winding mandrils which constitutes the winding mandril taking-up the wound package;

said means for supplying the separation element comprises a brakable supply spool for the separation element;

said separation element having an end thereof attached to the winding mandril which is in the process of taking-up the wound package;

means for withdrawing the separation element wound into the package; and means for braking the winding mandril which is paying-off the wound package.

5. The apparatus as defined in claim 4, further including:

rocker means having a stationary end;

said separation element being guided about said stationary end of said rocker means;

said rocker means having a free end region; and pressing means for pressing the free end region of said rocker means in the direction of a related one of the winding mandrils.

6. The apparatus as defined in claim 5, wherein:

said winding mandrils comprise two winding mandrils arranged in spaced relationship from one another to be driven in opposite rotational sense;

said rocker means comprising at least two rockers, each rocker being associated with one of the winding mandrils;

said rockers associated with the winding mandrils extending towards one another from their free rocker ends and forming a coherent guide means for the printed products;

infeed means for infeeding the printed products in the direction of the free end of one of the rockers;

said infeed means terminating in spaced relationship above said guide means; and the winding mandril operatively associated with said one rocker being provided with a disconnectable brake.

7. The apparatus as defined in claim 4, wherein:

said means for winding-up the printed products and for rewinding the printed products comprise substantially the same structure.

8. The apparatus as defined in claim 4, wherein:

said means for winding up the printed products and for rewinding the printed products comprise respectively different structure.

* * * * *

UNITED STATES PATENT AND TRADEMARK OFFICE

CERTIFICATE OF CORRECTION

PATENT NO. : 4,494,359

DATED : January 22, 1985

INVENTOR(S) : WERNER HONEGGER

It is certified that error appears in the above-identified patent and that said Letters Patent is hereby corrected as shown below:

Column 2, line 45, after "long" please insert --real--

Column 3, line 64, please delete "woulnd" and insert --wound--

Signed and Sealed this

*Seventeenth* Day of *September 1985*

[SEAL]

*Attest:*

DONALD J. QUIGG

*Attesting Officer*

*Commissioner of Patents and Trademarks—Designate*